US008132881B2

(12) United States Patent
Azami et al.

(10) Patent No.: US 8,132,881 B2
(45) Date of Patent: Mar. 13, 2012

(54) PRINTING APPARATUS, AND METHOD AND PROGRAM FOR CONTROLLING PRINTING APPARATUS

(75) Inventors: Osamu Azami, Shiojiri (JP); Koichi Nishiwaki, Matsumoto (JP); Masahiro Owa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 416 days.

(21) Appl. No.: 12/368,116

(22) Filed: Feb. 9, 2009

(65) Prior Publication Data

US 2009/0201330 A1 Aug. 13, 2009

(30) Foreign Application Priority Data

Feb. 12, 2008 (JP) ..... 2008-030437

(51) Int. Cl.
*B41J 29/38* (2006.01)

(52) U.S. Cl. ..... 347/14; 347/15; 347/19

(58) Field of Classification Search ..... 347/15, 347/14, 19

See application file for complete search history.

(56) References Cited

U.S. PATENT DOCUMENTS 5,721,573 A * 2/1998 Benjamin ..... 347/7
7,421,217 B2 9/2008 Sugita et al.
2005/0183595 A1* 8/2005 Kiyohara ..... 101/365
2007/0059015 A1 3/2007 Sakita et al.

FOREIGN PATENT DOCUMENTS

| | | | |
|---|---|---|---|
| JP | 10003203 A | | 1/1998 |
| JP | 11174909 A | | 7/1999 |
| JP | 11-221932 | | 8/1999 |
| JP | 2001-199085 | | 7/2001 |
| JP | 2003076231 A | | 3/2003 |
| JP | 2004-120029 | | 4/2004 |
| JP | 2005250302 A | | 9/2005 |
| JP | 2006103050 A | * | 4/2006 |
| JP | 2007-78887 | | 3/2007 |
| JP | 2007052297 A | | 3/2007 |
| JP | 2007078887 A | | 3/2007 |
| JP | 2007114596 A | | 5/2007 |

* cited by examiner

*Primary Examiner* — Laura Martin
(74) *Attorney, Agent, or Firm* — DLA Piper LLP (US)

(57) ABSTRACT

A printing apparatus that measures a consumption of a colorant during printing, includes a shade level measuring unit that measures a print shade level on a print sheet, a range segment counting unit that counts the number of print sheets falling within each of a plurality of print shade range segments based on the measurement results of the shade level measuring unit, and an output unit that outputs the count results of the range segment counting unit on a per print shade range segment basis.

6 Claims, 8 Drawing Sheets

FIG. 3

| | | SCALE WITH 100% MAXIMUM ON EACH COLOR | | | | SCALE WITH 400% MAXIMUM ON TOTAL OF KCMY COLORS |
|---|---|---|---|---|---|---|
| | | K | C | M | Y | |
| PRINT PAPER SHEET A | COVERAGE DUTY [%] | 5 | 3 | 6 | 4 | 18 |
| B | | 10 | 5 | 10 | 15 | 40 |
| C | | 50 | 80 | 70 | 85 | 285 |
| D | | 20 | 15 | 10 | 20 | 65 |
| E | | 10 | 5 | 10 | 5 | 30 |
| Z | | 3 | 2.2 | 3.1 | 3.6 | 11.9 |
| | AVERAGE COVERAGE DUTY | 5.0 | 3.4 | 6.1 | 2.8 | |
| | DUTY HUGE PRINT PAGES | 6 | 12 | 8 | 10 | 15 |
| | DUTY NORMAL PRINT PAGES | 34 | 140 | 133 | 40 | 138 |
| | DUTY LIGHT PRINT PAGE | 53 | 41 | 52 | 143 | 40 |

A B C D E F

FIG. 4

S

STATUS SHEET

PRINTER INFORMATION

| | |
|---|---|
| SERIAL NUMBER | XXXXXXXX |

PRINT COUNT

| | |
|---|---|
| TOTAL PRINT COUNT | XXXXXX |
| COLOR PRINT COUNT | XXXXXX |
| BLACK/WHITE PRINT COUNT | XXXXXX |

SYSTEM INFORMATION

| | |
|---|---|
| LAST JOB | MMMM DD YYYY HH : MM |
| JAMMING COUNT | XXXXXX |

PRINT OF PAPERS

| | TOTAL | MONO | COLOR |
|---|---|---|---|
| A3 | | | |
| A4 | | | |
| A5 | | | |
| B5 | | | |
| ⋮ | | | |

JOB

| | JOB | PAGES |
|---|---|---|
| ESC/PAGE | | |
| ESC/PAGE-S | | |
| PSL5 | | |
| ⋮ | | |

PAPER TYPE

| | MONO | COLOR | TOTAL |
|---|---|---|---|
| NORMAL | | | |
| THICK | | | |
| COATED | | | |
| ⋮ | | | |

PAGE DUTY

| | PAGES |
|---|---|
| HUGE | 15 |
| NORMAL | 138 |
| LIGHT | 40 |

COVERAGE DUTY

| | K | C | M | Y |
|---|---|---|---|---|
| LAST JOB COVERAGE [%] | 3.0 | 2.2 | 3.1 | 3.6 |
| AVERAGE COVERAGE DUTY [%] | 5.0 | 3.4 | 6.1 | 2.8 |
| DUTY HUGE [PAGES] | 6 | 12 | 8 | 10 |
| DUTY NORMAL [PAGES] | 134 | 140 | 133 | 40 |
| DUTY LIGHT [PAGES] | 53 | 41 | 52 | 143 |
| ESTIMATE [PAGES] | | | | |

| | K | C | M | Y |
|---|---|---|---|---|
| LAST JOB COVERAGE [%] | 3 | 2.2 | 3.1 | 3.6 |
| AVERAGE COVERAGE DUTY [%] | 5 | 3.4 | 6.1 | 2.8 |
| DUTY HUGE [PAGES] | 6 | 12 | 8 | 10 |
| DUTY NORMAL [PAGES] | 134 | 140 | 133 | 40 |
| DUTY LIGHT [PAGES] | 53 | 41 | 52 | 143 |

PRINTING APPARATUS, AND METHOD AND PROGRAM FOR CONTROLLING PRINTING APPARATUS

BACKGROUND

1. Technical Field

The present invention relates to a printing apparatus, and a method and program for controlling the printing apparatus and, in particular, to a technique of measuring a consumption of a colorant during printing.

2. Related Art

In a printing apparatus, the consumption of a colorant has been measured and then referred to as a criterion whether to perform a cleaning operation or a colorant cartridge replacement operation on the printing apparatus. For example, Japanese Unexamined Patent Application Publication No. 11-221932 discloses a printing apparatus that measures a cumulative count of dots formed through ink jet ejection, and thus indirectly calculates an ink consumption. Japanese Unexamined Patent Application Publication No. 2001-199085 discloses a printing apparatus that measures beforehand an amount of ink consumed to print a typical document that is frequently printed by a user, and then determines based on the measurement data whether many copies of such a typical document can be printed when the remaining amount of ink becomes small.

A laser printing apparatus, in particular, measures a coverage duty as a print shade level, and presents an average coverage duty (%) to the user. The coverage duty is a ratio of a colorant sticking area to a print sheet, and, for example, to a colorant consumption with respect to an area of a sheet size A4 being 100%. More specifically, by multiplying the average coverage duty by the number of pages (print count), a colorant consumption (%) is calculated. If the service life of a colorant cartridge is 5000 sheets on 5% printing on a A4 sheet size, the amount of colorant to be consumed is 25000 (=500×5) (%). The ratio of the amount of the consumed colorant (in other words, the ratio of the amount of the remaining colorant) is predicted based on the amount of colorant to be consumed and the calculated amount of consumed colorant.

There are times when the actual colorant consumption and the print shade level (coverage duty) are related as illustrated in FIG. 8. More specifically, in normal printing jobs, such as printing tables or graphs, the print shade level is proportional to the actual colorant consumption. However, in low shade level printing such as text printing that is typically performed at a print shade level lower than C1, the print shade level is not proportional to the actual colorant consumption. Even if the print shade level is lowered, a waste amount of colorant simply increases, and the colorant consumption is at a substantially constant level L. With high shade level printing such as photograph printing performed in a region above a high print shade level Ch, the print shade level is not proportional to the actual colorant consumption. Even if the print shade level is raised, the colorant consumption does not increase but remains at a predetermined value H.

The colorant consumption, if converted from the above described print shade level, may fail to equal the actual colorant consumption. Although an average usage method and an average usage status of the printing apparatus can be clarified by calculating the average coverage duty, a usage status not reflecting the actual usage status is not known. The mere mean of the print shade levels (coverage duties) is not sufficient as data according to which whether to perform the cleaning operation and maintenance job is determined.

SUMMARY

An advantage of some aspects of the invention is that a printing apparatus, and a method and program controlling the printing apparatus for verifying accurately a print status during printing are provided.

According to one aspect of the invention, a printing apparatus that measures a consumption of a colorant during printing, includes a shade level measuring unit that measures a print shade level on a print sheet, a range segment counting unit that counts the number of print sheets falling within each of a plurality of print shade range segments based on the measurement results of the shade level measuring unit, and an output unit that outputs the count results of the range segment counting unit on a per print shade range segment basis.

In accordance with the above aspect of the invention, a user or a service man may verify a print count at each print shade range segment, and accurately recognize a print status of the printing apparatus. A cleaning operation and maintenance job can be performed in a timely fashion. Since the print count at each print shade range segment is recognized together with the mean of the print shade levels, the user may learn that the actual colorant consumption is larger than the consumption of the colorant determined on the basis of the mean of print shade levels, and learn whether the actual colorant consumption indicates the necessity that the frequency of actual cleaning operations is set to be higher than the frequency of cleaning operations based on the mean of print shade levels.

Preferably, a plurality of colorant colors are employed, the shade level measuring unit measures the print shade level of the print sheet on a per colorant color basis, and the output unit outputs the count results of the range segment counting unit on a per colorant color basis. In this way, the print status is accurately recognized on a per colorant color basis.

Preferably, the output unit further outputs the measurement results of the shade level measuring unit regarding the print shade level on a print sheet printed last. This arrangement helps the user easily learn the measurement results regarding the print shade level.

Preferably, the print shade range segments include an intermediate shade range segment in which the consumption of the colorant increases with the print shade level raised, a low shade range segment in which a constant amount of colorant is consumed even with the print shade level lowered, and a high shade range segment in which the consumption of colorant is not increased above a predetermined amount even with the print shade level raised. The user can thus learn the frequency of printing performed on the print shade level that is not proportional to the actual colorant consumption. The count results are more effectively used in the cleaning operation and maintenance job.

Preferably, the shade level measuring unit measures the print shade level by calculating a ratio of an area printed in accordance with print data that defines whether to print or not for each pixel on a predetermined print sheet. The user can thus accurately learn the print shade level.

The teaching of the invention is applicable not only to the printing apparatus but also to a control method of the printing apparatus.

The teaching of the invention is also applicable to a control program executed by a computer that performs the control method of the printing apparatus.

The printing apparatus of the embodiments of the invention may be applied to not only a printer having a printing function but also to a complex apparatus having, in addition to the printing function, at least one of a scanner function, a facsimile function, and a copying function.

BRIEF DESCRIPTION OF THE DRAWINGS

The invention will be described with reference to the accompanying drawings, wherein like numbers reference like elements.

FIG. 3 illustrates measurement results of coverage duty.

FIG. 4 illustrates a status sheet of a printer.

DESCRIPTION OF EXEMPLARY EMBODIMENTS

The embodiments of the invention are described with reference to the drawings in the order described below.

Figure 1:
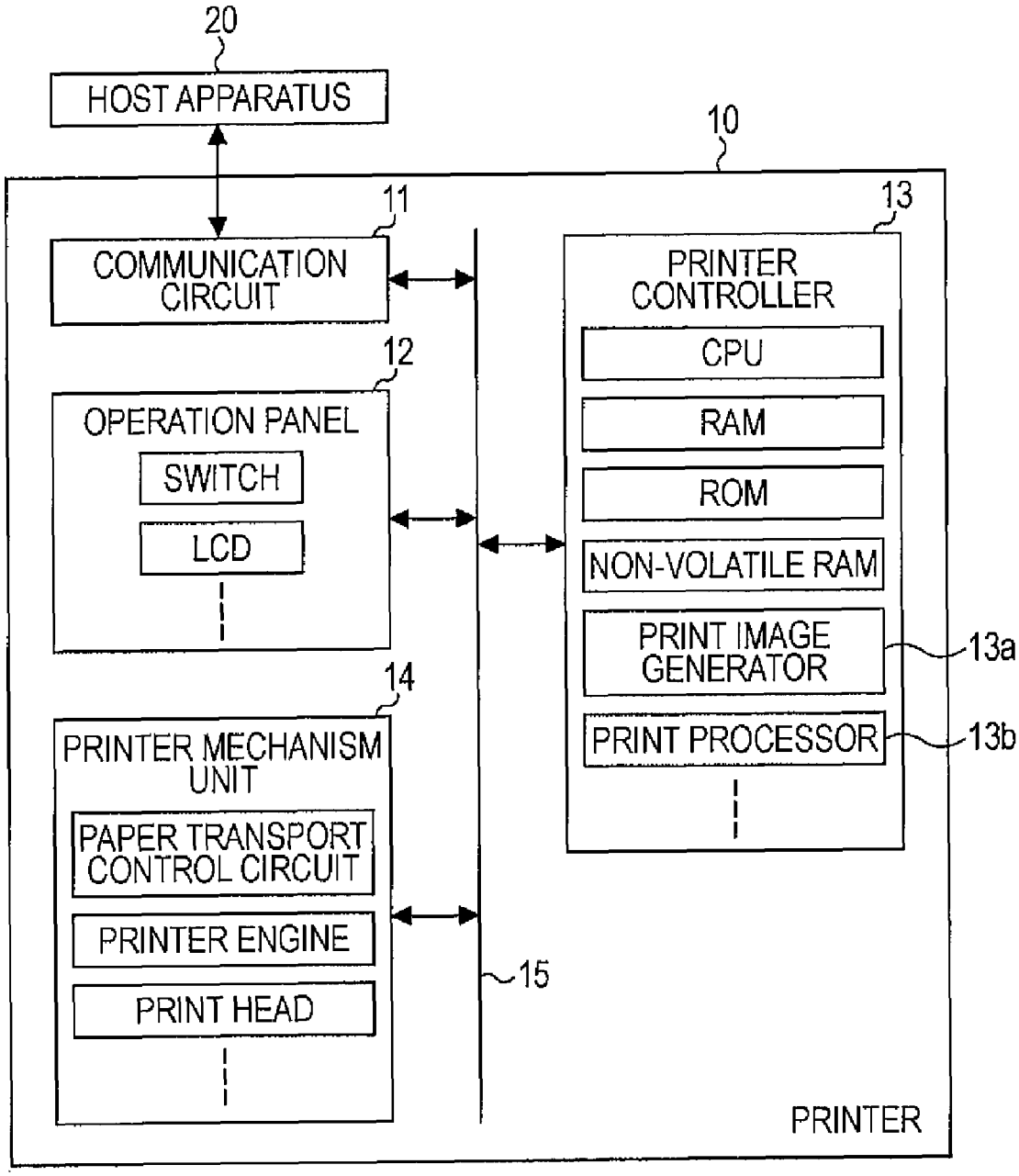
FIG. 1 is a block diagram generally illustrating a printing apparatus in accordance with one embodiment of the invention.

(1) Structure of a printer (2) Operation during printing (3) Modifications (4) Conclusion (1) Structure of a Printer FIG. 1 illustrates a printer 10 as a printing apparatus in accordance with one embodiment of the invention. Referring to FIG. 1, the printer 10 includes a communication circuit 11, an operation panel 12, a printer controller 13, a printer mechanism unit 14, and a bus 15. The printer 10 is a color printer that uses, as colorants, toners for cyan, magenta, yellow, and black (CMYK), and has laser print heads for each of CMYK colors. The printer 10 also includes a drum (not shown) that is exposed by the laser print head, rollers for transferring and fixing the toners onto a print sheet, and other elements.

The communication circuit 11 is a hardware unit for performing communications in accordance with protocols such as universal serial bus (USB) or transmission control protocol/Internet protocol (TCP/IP). The communication circuit 11 retrieves print command data from a host apparatus 20 and outputs the print command data to the printer controller 13. The print command data is produced by a document production application and a graphic application running on the host apparatus 20. The print command data contains a rendering command for rendering an image and a variety of parameters controlling the printer 10.

The operation panel 12 is a user interface unit serving as an interface between a user and the printer 10 (printer controller 13). The operation panel 12 includes a plurality of push buttons for receiving a user operation, a liquid-crystal display (LCD) displaying a variety of messages indicating the status of the printer 10, and other elements. The term user operation refers to one of an instruction operation for instructing a print layout, an output operation for outputting a status sheet of the printer 10, and an input operation to be performed in response to an error.

The printer controller 13 includes a print image generator 13*a* and a print processor 13*b* in addition to a central processing unit (CPU), a random-access memory (RAM), a read-only memory (ROM), a memory controller, and a nonvolatile RAM. The printer controller 13 causes the print image generator 13*a* and the like to generate a print responsive to the print command data received from the host apparatus 20, and sends status information representing the status of the printer 10 (such as information relating to a usable function and remaining expendables) to a device that has requested such status information. The CPU generally controls each element in the printer controller 13 in accordance with a program stored on the ROM or the like. The RAM stores temporarily the print command data received by the communication circuit 11 or the like, and data which the print image generator 13*a* has created in response to the print command data. The ROM is a non-volatile memory that stores a variety of programs in a compressed form. Such programs are loaded to the RAM and then executed by the CPU. In response to a command from the CPU, the memory controller transfers data to the RAM from the communication circuit 11 or the like, and transfers data from the RAM to a printer engine in the printer mechanism unit 14. The non-volatile RAM is a reprogrammable non-volatile memory (such as electrically erasable programmable read-only memory (EEPROM) or non-volatile random access memory (NVRAM)). The non-volatile RAM is mounted on the printer 10 (printer controller 13) as a memory continuously storing a variety of information regardless of power down.

The print image generator 13*a* performs a rendering operation in response to the rendering command, thereby generating print image data for a print image. The print processor 13*b* generates video data based on the premise that the print image data generated by the print image generator 13*a* is output to the laser print head.

Figure 2:
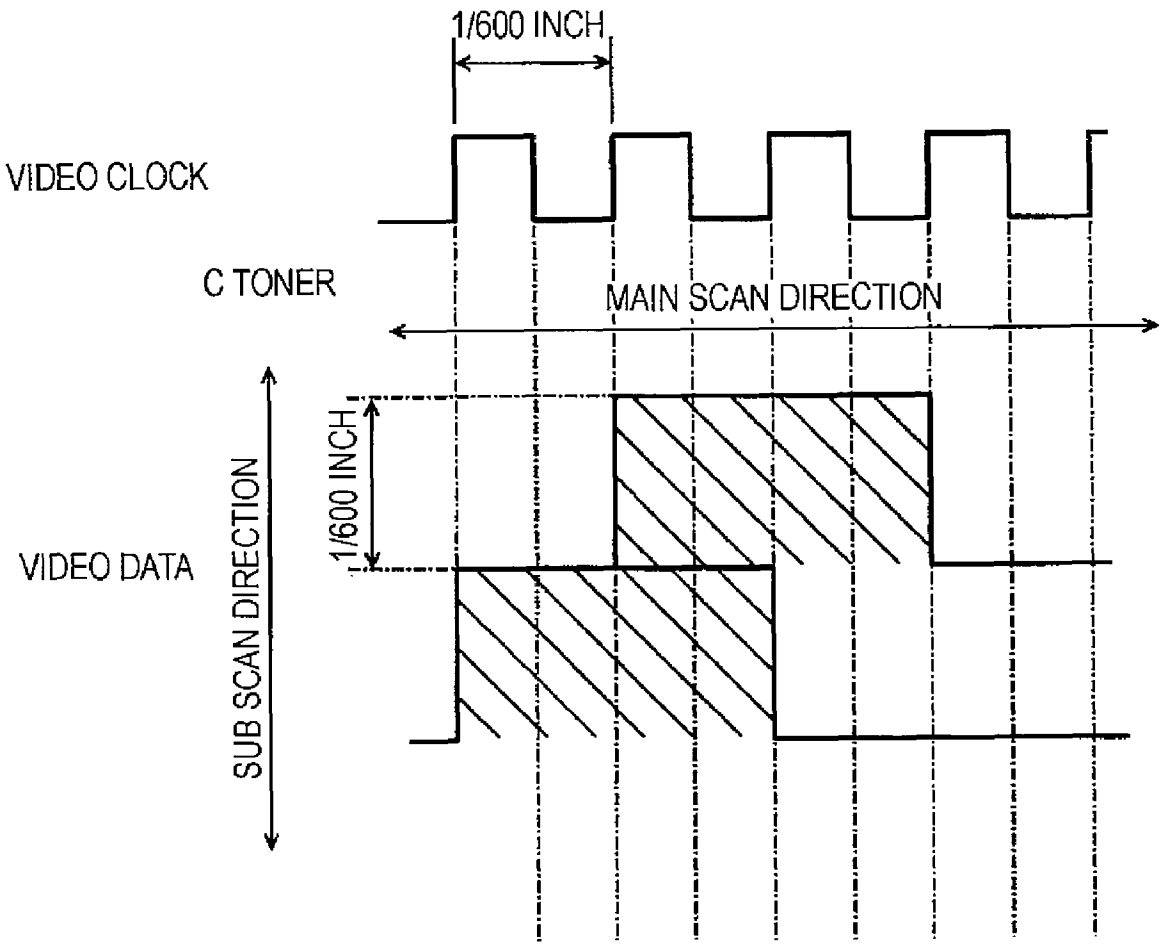
FIG. 2 illustrates video data.

FIG. 2 diagrammatically illustrates the video data. A portion of the video data for C channel is illustrated in FIG. 2. The video data is composed of a large number of pixels, each pixel containing position information in a main scan direction and a sub scan direction on a print sheet. The density of pixels is set to be 600 dpi in each of the two directions. The video data is print data defining print/no-print, i.e., specifies which pixel the toner is to stick to. The video data thus specifies on a per pixel basis which position the laser print head is to emit a laser to in the main scan direction. More specifically, the toner sticks to an ON position of the video data (hatched portions of the video data in FIG. 2). The video data described here is stored on the RAM, for example.

The printer mechanism unit 14 includes a paper transport control circuit, a printer engine, a print head, etc., and prints the image onto a supplied print sheet in accordance with the video data.

The host apparatus 20 is a generally available personal computer (with an operating system, a web browser, etc. installed thereon) connected to the printer 10. To cause the personal computer to function as the host apparatus 20, a printing apparatus control program particularly developed for the printer 10 and a utility program are also installed on the personal computer. The printing apparatus control program is a program (typically referred to as a printer driver) for generating the print command data, which is supplied to the printer 10 based on data related to a print target document handed over by an application program (and the operating system). The utility program is a program for presenting the environment in which the user of the host apparatus 20 may easily use reserve job data stored on the printer 10 (mainly stored by the user).

In the printer 10 thus constructed, the printer controller 13 includes a shade level sensor that measures a print shade level on a print sheet, a range segment counter that counts the number of print sheets falling within each of a plurality of print shade range segments based on the measurement results of the shade level sensor, and an output section that outputs the count results of the range segment counting unit on a per print shade range segment basis.

More specifically, the printer controller 13 measures the print shade level by calculating print pixels based on the video data generated by the print processor 13*b*. For example, the printer controller 13 calculates a printing area (area of printing, i.e., the sum of pixels as a printable target) from the print command data, calculates a toner sticking area (the area of the hatched portions of the video data illustrated in FIG. 2, i.e., the number of pixels to which the toner sticks) from the video data, and measures as the print shade level a coverage duty (%), which is a ratio of the toner sticking area to the printing area. In this embodiment, the printer controller 13 successively calculates the coverage duty on a per CMYK toner color basis on each print sheet (box labeled A in FIG. 3). The latest measurement results of the coverage duties, namely, the coverage duties on the print sheet printed last (enclosed within a box labeled B in FIG. 3) are successively stored on the non-volatile RAM, for example. The coverage duty value (life coverage) that is the sum calculated on a per toner color basis on the print sheets is also stored on the non-volatile RAM, for example.

The printer controller 13 then calculates the average coverage duties (enclosed within a box labeled C in FIG. 3), each mean coverage duty being calculated by dividing the life coverage of each color by a print count. The printer controller 13 also determines which of three print shade range segments the coverage duty measured on a per toner color basis falls within and calculates the number of pages (coverage on a per print shade range segment) printed in each print shade range segment on each toner color (enclosed within a box labeled D in FIG. 3). The three print shade range segments includes a low shade range segment, an intermediate shade range segment, and a high shade range segment. The printer controller 13 then determines which of the three print shade range segments each of the sums of the coverage duties of the toner colors (enclosed within a box labeled E in FIG. 3) on a per print sheet basis fall within, and counts the number of pages (page duty) printed in each print shade range segment (as labeled F in FIG. 3). The above-described average coverage duties, the coverage on each print shade range segment, and the page duty are stored on the non-volatile RAM, for example.

Figure 8:
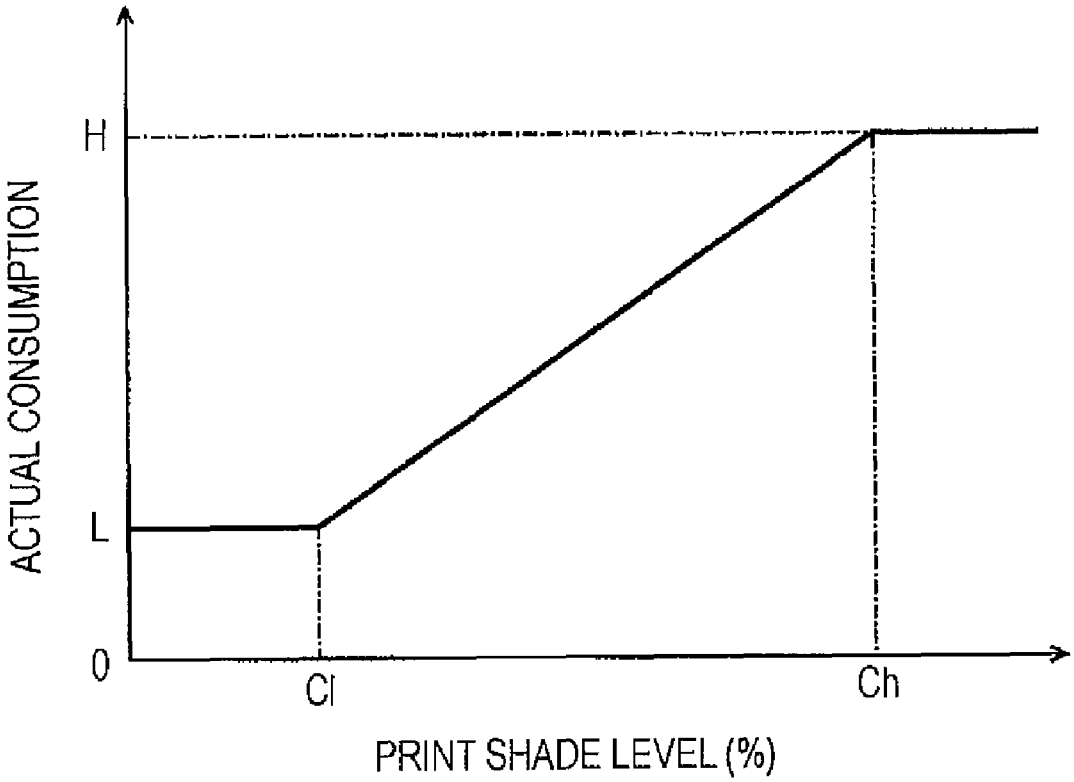
FIG. 8 illustrates a relationship between an actual toner consumption and a print shade level.

In the low shade range segment, the toner consumption remains substantially at about a constant value L even with the print shade level lowered. The low shade range segment may be a range extending downward from the low print shade level C1 as shown in FIG. 8, in which a print job of text or the like is typically performed. The intermediate shade range segment is a range extending from the low print shade level C1 to the high print shade level Ch as illustrated in FIG. 8, in which the actual toner consumption increases in proportional to a rise in the print shade level. In the intermediate shade range segment, tables, graphs, etc. are typically printed. The high shade range segment is a range extending upward from the high print shade level Ch, in which the actual toner consumption remains at about a constant value H even if the print shade level is raised. In the high shade range segment, photographs or the like are typically printed.

When an output request for a status sheet of the printer 10 is received in response to a user operation performed on the operation panel 12, the printer controller 13 outputs a status sheet S illustrated in FIG. 4, for example. In this embodiment, the page duty, in particular, is output on the status sheet S. In addition to the page duty, the coverage on each of the duty ranges (the duty huge range (high shade range segment), the duty normal range (intermediate shade range segment), and the duty light range (low shade range segment)), and the last job coverage of a last print job are output as the coverage duties.

The printer controller 13 may calculate the sum of pages printable with the average coverage duty by dividing the amount of toner (%) available by the average coverage duty, and then calculate the remaining printable pages (the estimated number of pages) by subtracting the printed pages from the sum of printable pages. The printer controller 13 may calculate the toner consumption (%) by multiplying the average coverage duty by the number of printed pages, and then calculate the estimated number of pages from the toner consumption. The estimated number pages may be output on the status sheet S as "Estimate in Coverage Duty" as illustrated in FIG. 4. The estimated number of pages is calculated based on the average coverage duty, and there is a possibility that a difference between the estimated number of pages and the actual number of pages increases. This is more so if the number of pages is large in the low shade range segment or the high shade range segment. The user may predict such a difference of the estimated number of pages by referencing the coverage on each of the print shade range segments and the page duty.

(2) Operation During Printing

Figure 5:
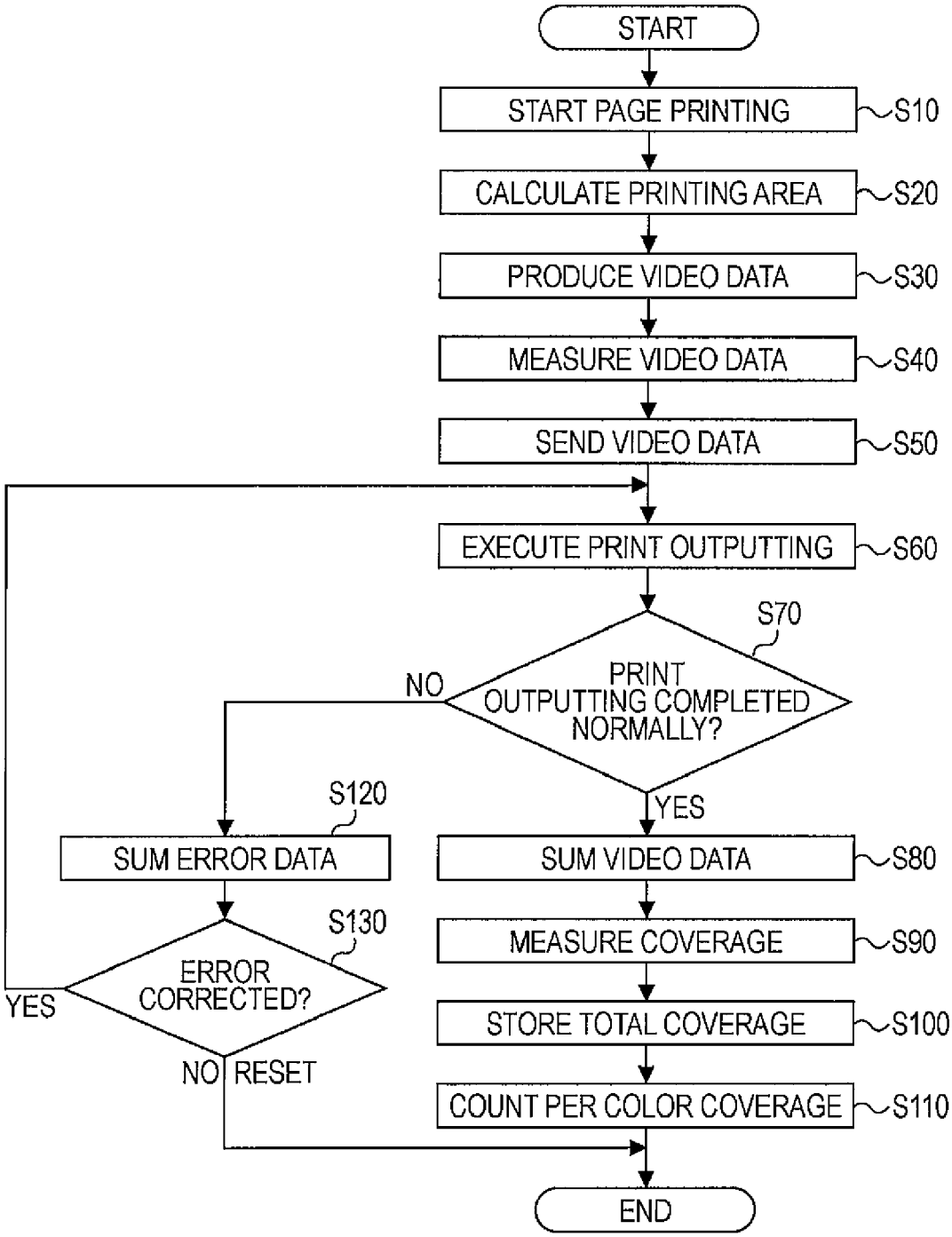
FIG. 5 is a flowchart illustrating a printing process executed by a printer controller.

FIG. 5 is a flowchart illustrating a print control process executed by the printer controller 13. In step S10, the host apparatus 20 outputs the print command data, and page printing starts. In S20, the printer controller 13 calculates a printing area from the print command data. In S30, the printer controller 13 generates the video data on the premise that the print image data generated in response to the rendering command of the print command data is output to the laser print head. In S40, the printer controller 13 calculates a toner sticking area from the video data. In S50, the printer controller 13 transfers the video data to the printer mechanism unit 14. In S60, print outputting is performed.

In S70, the printer controller 13 determines whether the print outputting has been normally completed. If it is determined in S70 that the print outputting has been normally completed, the printer controller 13 counts the total number of pages. In S90, the printer controller 13 measures the coverage duty on each paper sheet (=toner sticking area/printing area (%)) on each of CMYK colors from the toner sticking area and the printing area. In this case, the coverage duty on a print sheet printed last is successively stored on the non-volatile RAM, for example. In S100, the printer controller 13 stores on the non-volatile RAM the sum of the coverage duties (life coverage duty) of the pages on a per toner color basis. The printer controller 13 then calculates the average coverage duty on a per toner color basis (=life coverage/the sum of printed pages (%)). The average coverage duty is stored on the non-volatile RAM, for example. In S110, the printer controller 13 determines which of the print shade range segments the coverage duty calculated on a per toner color basis falls within, and then counts the coverage on a per print shade range segment. The printer controller 13 also sums the coverage duties of the toner colors on a per page basis, determines which of the print shade range segments the sum of the coverage duties of the toner colors falls within, and counts the page duties. In this case, the coverage on a per print shade range segment and the page duty are stored on the non-volatile RAM, for example.

If paper jamming takes place in the printer 10, it is determined in S70 that the print outputting has not been normally completed. In S120, the number of errors, such as a cumulative number of paper jams, is counted. In S130, the printer controller 13 determines whether the error has been corrected. If the answer to the determination in S130 is affirmative with the error corrected, processing returns to S60 to resume a print job. If the answer to the determination in S130 is non-affirmative with the print job reset, the routine thus ends.

(3) Modifications

Figure 6:
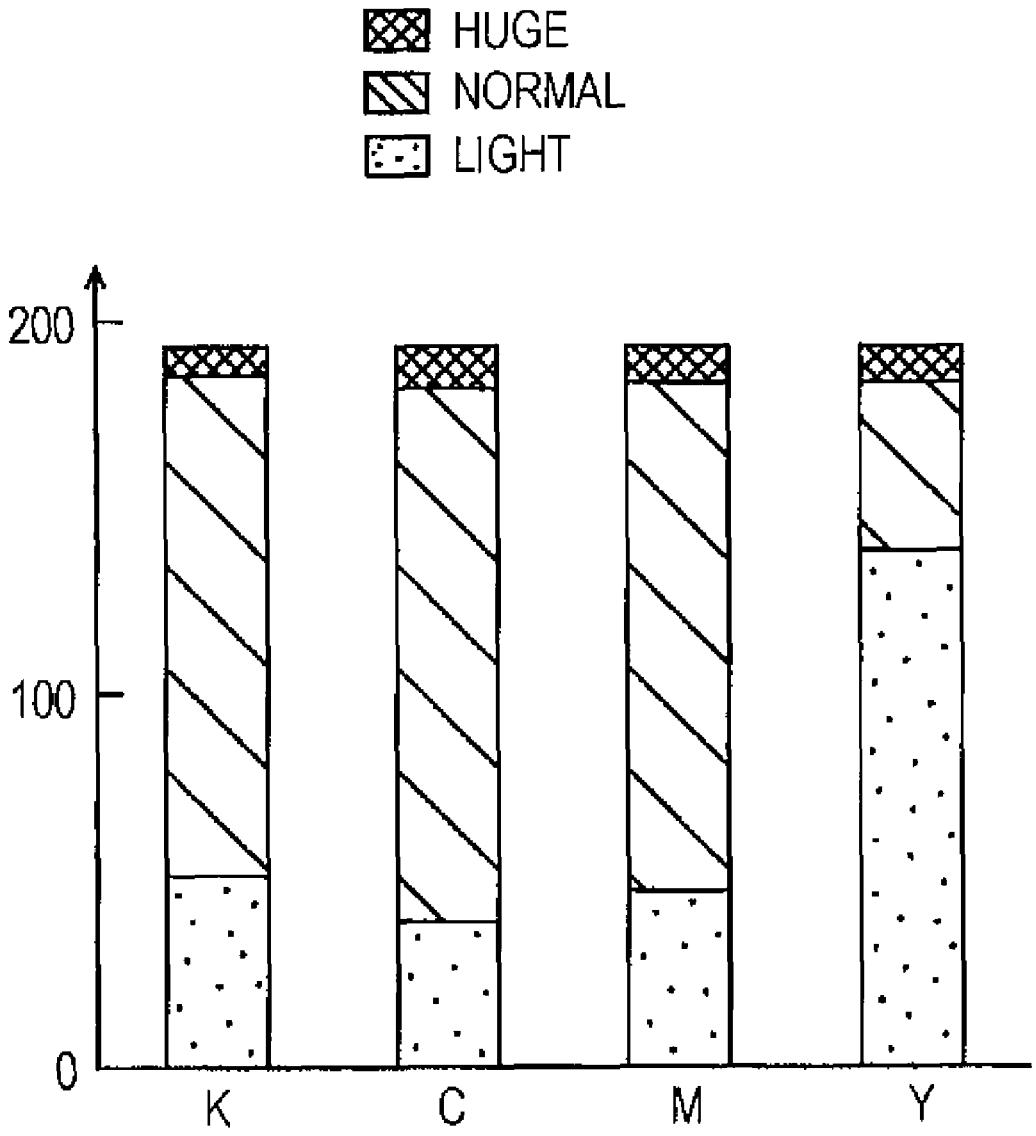
FIG. 6 is a graph plotting a coverage on a per print shade range segment.

The page duty, the coverage on each shade range segment (the duty huge range, the duty normal range, the duty light range), and the last job coverage at last print job may be not only displayed on the status sheet S, but also displayed in a graph. For example, the coverage on a per print shade range segment may be plotted in a graph as illustrated in FIG. 6.

Figure 7:
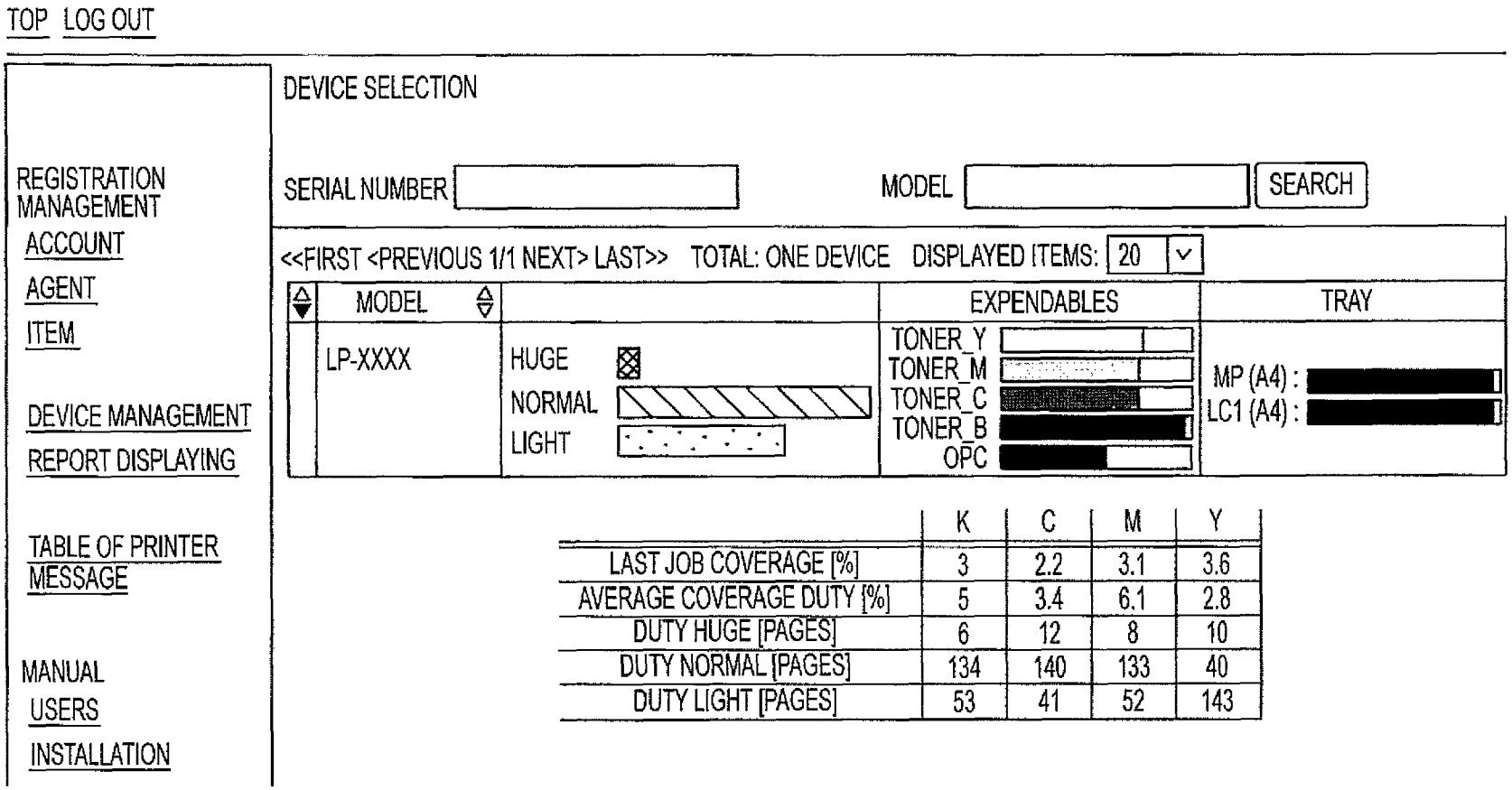
FIG. 7 illustrates measurement results displayed on a host apparatus.

Similarly, the page duty, the coverage on each shade range segment (the duty huge range, the duty normal range, the duty light range), and the last job coverage at last print job may be displayed not only on the status sheet but also on the host apparatus 20. For example, these pieces of information may be displayed on a web browser of the host apparatus 20 as shown in FIG. 7. These pieces of information may be also displayed using a utility program of the printer 10 installed on the host apparatus 20.

(4) Conclusion

With the printer 10, the user or service man can view the page count of each of the print shade range segments on a per toner color basis, such as the page duty and the coverage of each of the print shade range segments. The user or service man, recognizing accurately the print status, can properly perform the cleaning operation and maintenance job. For example, the user can learn the print count in each print shade range segment together with the average coverage duty. The user can thus learn that the actual toner consumption is larger than the consumption of the toner determined on the basis of the average coverage duty (that the duty light page count is high), and learn whether the actual toner consumption indicates the necessity that the frequency of actual cleaning operations (the duty huge page count is high) is set to be higher than the frequency of cleaning operations based on the average coverage duty.

Since the coverage duty of the print sheet printed last is output, the user can easily recognize the measurement results by comparing a last printout with the coverage duty.

The embodiments of the invention have been discussed with reference to the drawings. The invention is further applicable in another embodiment.

In addition to counting the number of pages on a per print shade range segment basis, the average of the coverage duties may be calculated on a per print shade range segment basis and then output.

In accordance with the preceding embodiments, the print shade range segments include the duty huge range, the duty normal range, and the duty light range. However, if at least two print shade range segments of the duty huge range and the duty light range are used, a certain degree of advantage can be still achieved. Alternatively, the print shade may be segmented into finer ranges. With such an arrangement, the cleaning operation and maintenance job may be more properly performed.

The coverage duty of the print sheet printed last may not be necessary. The page duty and the coverage of the print shade range segment of any data may be perfectly acceptable.

In the above-described embodiments, the printer 10 is a color printer employing the CMYK toners. The invention is applicable to a printer that uses a monochrome toner.

In the above-described embodiments, the video data defines print/no-print setting to each pixel. In addition, a pseudo-intermediate gradation process may be performed on the video data so that each pixel has gradation information of 64-level gradation (0/63-63/63%: 6 bits) indicating the toner sticking area ratio in each pixel. Furthermore, each pixel may have congregation information specifying where to place a toner sticking area on the pixels, in addition to the toner sticking area ratio.

The teaching of the invention applied to the printer 10 is also applicable to a control method of the printer 10. The teaching of the invention is also applicable to a control program of the printer 10 so that a function of each element of the printer 10 is executed by the printer controller 13.

The above embodiments of the invention have been described for exemplary purposes only. It will be apparent to those skilled in the art that a variety of changes and modifications are possible to the above-described embodiments without departing from the scope of the invention.

The entire disclosure of Japanese Patent Application No. 2008-030437, filed Feb. 12, 2008 is expressly incorporated by reference herein.

What is claimed is:

1. A printing apparatus that measures a consumption of a colorant during printing, comprising:

a shade level measuring unit that measures a print shade level on a print sheet;

a range segment counting unit that counts the number of print sheets falling within each of a plurality of print shade range segments based on the measurement results of the shade level measuring unit; and an output unit that outputs the count results of the range segment counting unit on a per print shade range segment basis, wherein the print shade range segments include an intermediate shade range segment in which the consumption of the colorant increases with the print shade level raised, a low shade range segment in which a constant amount of colorant is consumed even with the print shade level lowered, and a high shade range segment in which the consumption of colorant is not increased above a predetermined amount even with the print shade level raised.

2. The printing apparatus according to claim 1, wherein a plurality of colorant colors are employed, wherein the shade level measuring unit measures the print shade level of the print sheet on a per colorant color basis; and wherein the output unit outputs the count results of the range segment counting unit on a per colorant color basis.

3. The printing apparatus according to claim 1, wherein the output unit further outputs the measurement results of the shade level measuring unit regarding the print shade level on a print sheet printed last.

4. The printing apparatus according to claim 1, wherein the shade level measuring unit measures the print shade level by calculating a ratio of an area printed in accordance with print data that defines whether to print or not for each pixel on a predetermined print sheet.

5. A control method of a printing apparatus that measures a consumption of a colorant during printing, comprising:

measuring a print shade level on a print sheet;

counting the number of print sheets falling within each of a plurality of print shade range segments based on the measurement results of the print shade level; and outputting the count results of print sheets on a per print shade range segment basis, wherein the print shade range segments include an intermediate shade range segment in which the consumption of the colorant increases with the print shade level raised, a low shade range segment in which a constant amount of colorant is consumed even with the print shade level lowered, and a high shade range segment in which the consumption of colorant is not increased above a predetermined amount even with the print shade level raised.

6. A control program for causing a computer to perform a control method of a printing apparatus that measures a consumption of a colorant during printing, comprising:

measuring a print shade level on a print sheet;

counting the number of print sheets falling within each of a plurality of print shade range segments based on the measurement results of the print shade level; and outputting the count results of print sheets on a per print shade range segment basis, wherein the print shade range segments include an intermediate shade range segment in which the consumption of the colorant increases with the print shade level raised, a low shade range segment in which a constant amount of colorant is consumed even with the print shade level lowered, and a high shade range segment in which the consumption of colorant is not increased above a predetermined amount even with the print shade level raised.

* * * * *